United States Patent [19]

Sommer

[11] Patent Number: 4,530,124

[45] Date of Patent: Jul. 23, 1985

[54] DEVICE FOR TOE AND BALL LASTING OF A SHOE UNIT

[75] Inventor: Gerald Sommer, Lemberg, Fed. Rep. of Germany

[73] Assignee: International Shoe Machine Corporation, Nashua, N.H.

[21] Appl. No.: 534,537

[22] Filed: Sep. 22, 1983

[30] Foreign Application Priority Data

Dec. 7, 1982 [DE] Fed. Rep. of Germany ..... 3245120

[51] Int. Cl.[3] ..... A43D 21/16; A43D 21/00

[52] U.S. Cl. ..... 12/12.4; 12/12; 12/12.2

[58] Field of Search ..... 12/10.1, 12, 12.2, 12.21, 12/12.4, 12.41

[56] References Cited

U.S. PATENT DOCUMENTS

| | | | |
|---|---|---|---|
| 3,196,470 | 7/1965 | Bourer | 12/12.4 |
| 3,226,749 | 1/1966 | Marquis et al. | 12/12 |
| 3,258,799 | 7/1966 | Weinschenk | 12/12 |
| 3,264,666 | 8/1966 | Akerley | 12/12 |
| 4,280,242 | 7/1981 | Gilbride | 12/12.4 |
| 4,470,165 | 9/1984 | Becka | 12/12 |

FOREIGN PATENT DOCUMENTS

| | | | |
|---|---|---|---|
| 2021376 | 11/1971 | Fed. Rep. of Germany | 12/12.4 |
| 2105572 | 3/1983 | United Kingdom | 12/12.2 |

*Primary Examiner*—Werner H. Schroeder
*Assistant Examiner*—Steven N. Meyers
*Attorney, Agent, or Firm*—Robert Shaw

[57] ABSTRACT

A device for toe and ball lasting a shoe unit consisting of a last with a shoe upper superimposed thereon and an insole arranged on the last bottom comprises main wipers seated above the shoe support for linear movement and pivotal movement about a fulcrum point and carrying, on their side opposite the fulcrum point, ball wipers arranged for longitudinal displacement.

In order to achieve perfect wiping results in the ball area, irrespective of the length, i.e., size of the shoe unit being processed, without the need to perform troublesome adjusting or setting work on the wipers, the device is provided with a sensing element for scanning the length of the shoe unit placed upon the shoe support, and for emitting a signal indicative of the length of the said shoe unit, the said sensing element coacting with adjusting means which are controlled by the said signal and which serve to automatically adjust the initial position of the ball wipers on the main wipers to the respective length of the shoe unit.

9 Claims, 5 Drawing Figures

DEVICE FOR TOE AND BALL LASTING OF A SHOE UNIT

The invention relates to a device for toe and ball lasting a shoe unit consisting of a last with a shoe upper superimposed thereon and an insole arranged on the last bottom, comprising a shoe support acting against the shoe bottom to support the shoe unit, a heel holder with adjusting means for movement towards and away from the shoe support, and main wipers seated above the shoe support for linear movement and pivotal movement about a fulcrum point and carrying, on their side opposite the fulcrum point, ball wipers arranged for longitudinal displacement, the main wipers being provided with corresponding drive means for moving them, in a combined longitudinal and pivotal inward movement, below the contour of a shoe unit placed on the shoe support, wiping simultaneously the lasting margin of the upper against the insole, during which combined movement the ball wipers can be moved by corresponding adjusting means, from an initial rearward position towards the fulcrum point.

A device for toe and ball lasting of the type described before has been known in practice. By the described combined linear and pivotal movement of the main wipers, a uniform distribution of the wiping margin of the upper during the inward movement is achieved whereby any undesirable wrinkling of the material is prevented. The ball wipers follow the circular pivotal movement performed by the main wipers and are additionally linearly moved from their initial position towards the fulcrum point so that good wiping results are achieved also in the ball area which exhibits a relatively small radius of curvature.

In practical operation of such a device, the initial position of the ball wipers is adjusted once in a mechanical manner to the largest shoe unit of the production line to be processed on the particular device. As a rule, the adjustment is such that the distance between the ball wipers and the so-called ball point of the largest shoe unit is approximately 10 mm. Experience shows that this adjustment gives good wiping results for this large shoe unit.

But the wiping results get less satisfactory as the size of the shoe units in the production line (21.5–9) decreases. The reason for this is to be seen in the fact that the wiping movement to be performed by the ball wipers, from the adjusted fixed initial position to the point of engagement of the lasting margin in the area of the ball point, gets longer as the size of the shoe unit decreases. It may even happen that the circular pivotal movement of the main wipers has been completed before the ball wipers, moving linearly relative to the main wipers, have even made contact with the lasting margin. As a result thereof, the material of the lasting margin of the upper is unevenly distributed so that wrinkles and accumulations of material may form.

Now, it is an object of the invention to eliminate these difficulties and to provide a toe and ball lasting device giving satisfactory wiping results in the ball area, irrespective of the length, i.e., the size, of the shoe unit being processed, and without the need to perform troublesome adjusting or setting operations on the wipers.

According to the invention, this problem is solved by a device of the type described above which is characterized in that the device comprises a sensing element for scanning the length of the shoe unit placed upon the shoe support, and for emitting a signal indicative of the length of the said shoe unit, the sensing element coacting with adjusting means which are controlled by the signal and which serve to automatically adjust the initial position of the ball wipers on the main wipers to the respective length of the shoe unit.

The sensing element ensures that at the beginning of the wiper travel, the ball wipers are in the correct position for the particular shoe unit to be processed so that the lasting margin material of the upper in the area of the ball point is properly engaged by them during the inward movement, and evenly distributed.

In a preferred embodiment of the invention, the sensing element is coupled with the heel-holding means so that the ball wipers are automatically moved into the correct initial position when the shoe unit is clamped in the heel-holding means.

The interconnection between the sensing element and the adjusting means of the ball wipers is advantageously effected via a servo control. The latter may in one embodiment comprise a hydraulic or pneumatic jack whose cylinder volume can be varied by the sensing element in response to the length of the shoe unit, and communicates via a line with a cylinder volume of at least one jack of the adjusting means of the ball wipers. The sensing element varies the volume of the jack of the servo control so that fluid, for instance oil, may be displaced from the cylinder and supplied to the jack of the adjusting means which acts as slave cylinder and which, accordingly, effects the corresponding adjustment of the ball wipers. In order to enable the ball wipers to be correctly reset upon termination of the wiping process, the jack of the adjusting means may conveniently comprise resetting means which may for instance take the form of a pressure line to which the necessary resetting pressure can be supplied.

The fluid-filled line between the before-mentioned jacks may advantageously communicate with at least one fluid-filled space comprising a wall capable of being adjusted by corresponding adjusting means. By varying the volume of this space, the ball wipers may, if necessary, be manually influenced as regards their symmetrical adjustment. The fluid-filled space may conveniently be constituted by one cylinder space of a secondary jack which has its other cylinder space connected to a pressure liquid which serves to apply pressure to the ball wipers to ensure that they move exactly over the residual distance to the ball point.

In another embodiment of the invention, the sensing element may be coupled to an electric signal generator, while the adjusting means of the ball wipers comprises at least one electric setting element which is controlled by the signal generator via a control circuit of the servo control.

Certain examples of embodiments of the invention are represented in the drawing in which.

Figure 1:
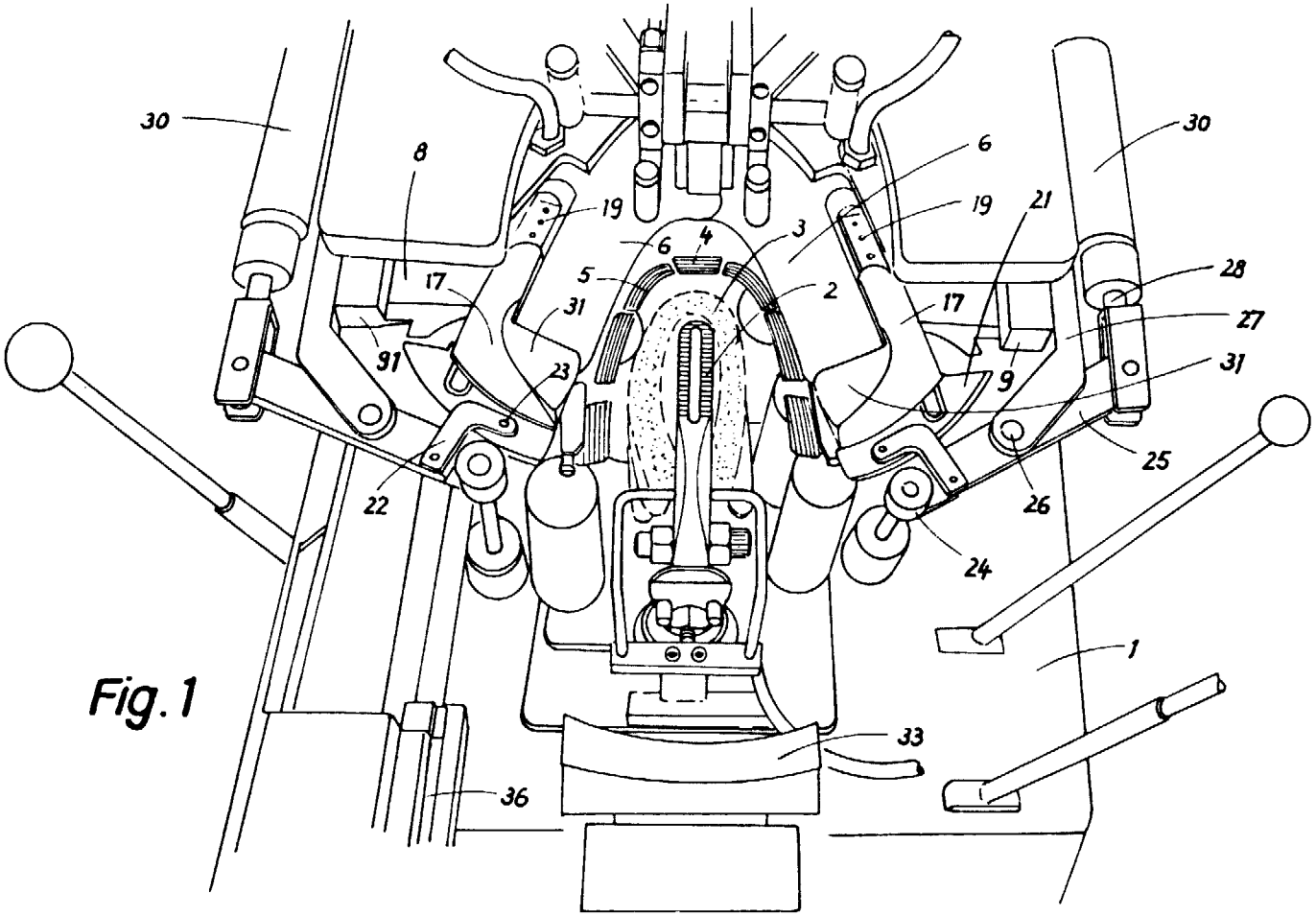
FIG. 1 shows a partial perspective representation of a device for toe and ball lasting a shoe unit, in accordance with the invention.

The lasting machine shown in FIG. 1 serves for toe and ball lasting a shoe unit. It comprises a boxlike housing 1 carrying a shoe support 2 surrounded by a toe clamp 3 serving to apply freely flowing shoe cement to the insole of a shoe unit placed upon the shoe support 2. Around the toe clamp 3, which exhibits the shape of a horseshoe, there are provided toe and ball pincers 4,5 which are conventionally seated on the housing 1 to permit them to perform a heightwise and lateral pivotal movement relative to the shoe support 2.

Two main wipers 6 are provided in a plane extending slightly above the shoe support 2. The main wipers 6 are seated on a carriage 8 for rotation about a common fulcrum point 7. The carriage 8 is mounted in corresponding guides 91 of the housing 1 for longitudinal displacement towards and away from the shoe support 2. The carriage 8 carries a pneumatic jack 9 which acts as drive means for the main wipers 6 and which has its piston rod 10 connected with a crosspiece 11 which in turn is linked to the main wipers 6 via two links 12 the ends of which are pivotally fastened at the points 14,13 to the crosspiece 11 and the main wipers 6, respectively. In addition the carriage 8 is interconnected with a jack—not shown in the drawing—fixed at the housing 1 by which it can be moved linearly along the guides 9. Thus, when moving inwardly, the main wipers 6 can perform a combined movement composed on the one hand by the inwardly directed pivotal movement about the common fulcrum point 7 indicated by the arrows 15 and, on the other hand, by a linear movement in the direction indicated by the arrows 16.

The face of the main wipers 6 opposite the fulcrum point 7 carries segment-shaped ball wipers 17 which can be moved towards and away from the fulcrum point 7 in the direction indicated by the double arrows 18. To permit this adjustment, each of the main wipers 6 is provided with a dovetailed web 19 on which the ball wipers 17 which are provided with a corresponding groove 20 are slidably mounted.

Each of the ball wipers 17 is provided in the area of its outer rim with a curved upwardly open groove 21 which is engaged by a pin 23 of a follower 22, while a supporting roller 24 bears against the outer, likewise curved rim of the ball wiper 17. The follower 22 and the supporting roller 24 are pivotally seated on a two-armed lever 25 which is hinged at 26 on a support 27 which is in turn connected to the carriage 8. The end of the lever 25 opposite the supporting roller 24 is connected to the piston rod 28 of a jack 30 which is fastened on the carriage 8 via a holder 29 and which forms together with the lever 25 means for adjusting the associated ball wiper 17.

Figure 3A:
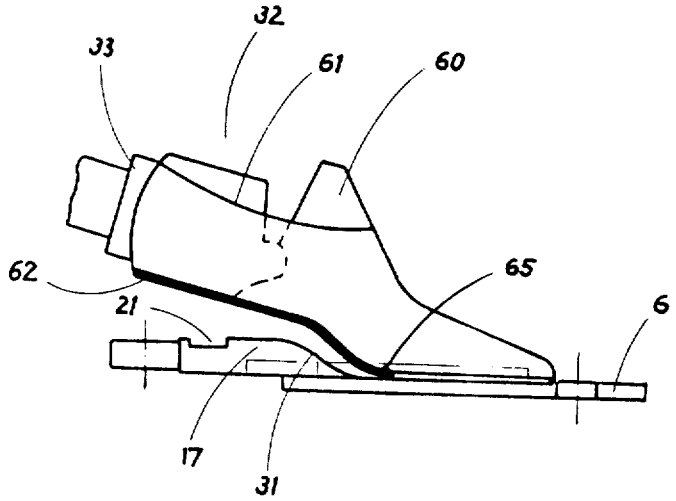
FIGS. 3A and 3B are lateral views of the two shoe units of different lengths (sizes) mounted in the device shown in FIG. 2, illustrating in particular the main and ball wipers.
Figure 3B:
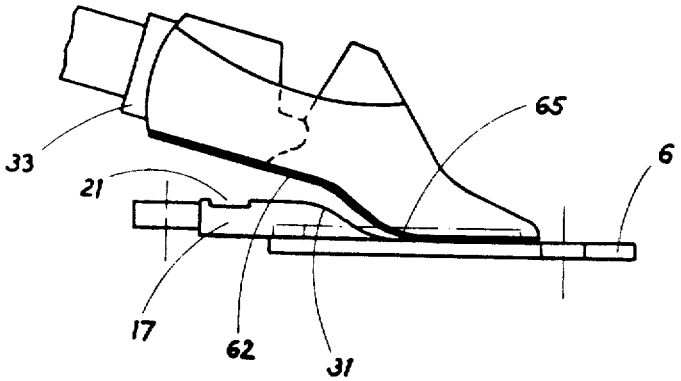

As appears from FIGS. 3A, 3B, the cross-section of the ball wipers 17 exhibits at 31 a curvature conforming to the camber of the shoe unit indicated at 62.

The shoe support 2 carries on the side opposite the fulcrum point 7 a heel clamp 33 mounted on a support 35 for limited pivotal movement about a vertical axis 34. The support 35 can be adjusted towards and away from the shoe support 2, in the direction of the double arrow 31, along a guide rail 36 mounted on the housing 1. A jack 37 mounted on the housing 1 in the area of the inside of the guide rail 36 has its piston rod 38 connected with the support 35 via a threaded spindle 39 so that the piston rod 38 follows every displacement of the support 35 along the guide rail 36. The cylinder space 40 of the jack 37 which forms part of the servo control communicates via a line 41 with the end-side cylinder space 42 of the two jacks 30 serving for adjusting the ball wipers 17.

Instead of the jack 37, which has its cylinder space 40 connected with both jacks 30, there may also be provided two jacks 37. In this case, the jacks 37 are arranged one above the other—as viewed in FIG. 2—and have their piston rods 38 fastened to the support 35 in the described manner, the arrangement being such that each of the jacks 30 is connected with a cylinder space 40 of one of the said jacks 37.

Two branch lines 43 branching off on both sides from the line 41 which is filled with an incompressible liquid, such as oil, lead to secondary cylinders 44 mounted via a holder 46 on the carriage 8. The piston rods 48 of the two secondary cylinders 44 are subjected to the action of a return spring 47 and coupled with manually operable threaded adjusting means 49 which enable the piston rod 48 and the piston 48*a* to be displaced relative to the secondary cylinder 44 so as to vary the volume of the cylinder space 50 communicating with the branch line 43.

The other cylinder space 51 of each of the secondary cylinders 44 is connected via a speed-control valve 52 and a pressure line 53, and via a pilot valve 54 to a pressure-relief valve indicated at 56 and a compressed-air source.

The cylinder space 57 of the two jacks 30, opposite the cylinder space 42 which communicates with the liquid-filled lines 41, is likewise connected by a compressed-air line 58 to a compressed-air source and a pressure-relief valve 59.

The operation of the device described before is as follows:

when a shoe unit 32 comprising a last 60 with a shoe upper 61 mounted thereon, and an insole 62 arranged on the shoe bottom has been placed upon the shoe support 2, and the lasting margin of the upper of the shoe unit 32 has been introduced into the forepart pincers 4,5, the heel clamp 33 is moved foreward in the direction indicated by the arrow 31 and brought into engagement with the heel of the shoe unit 32. During this movement, the piston rod 38 of the jack 37 is pushed forward, i.e., towards the fulcrum point 7, by the support 35 which acts as sensing element, whereby a quantity of fluid is displaced from the cylinder space 40 via the line 41 into the cylinder space 42 of the two jacks 30. As a result thereof, the piston rods 28 of the jacks 30 are moved forward, so that the levers 25 and the supporting rollers 24 advance the two ball wipers 17 in the direction indicated by the arrows 18, relative to the main wipers 6, until they reach their respective initial positions, depending on the selected internal diameter of the jacks 37,30.

Then, when the shoe upper 61 has been stretched over the last 60 by corresponding operation of the pliers 3,4, the carriage 8 is moved in the direction indicated by the arrow 16 towards the shoe unit 32 mounted in the device. At the same time, compressed air is admitted to the jack 9 so that the main wipers 6 perform a combined closing movement composed of a linear movement in the direction of the arrow 16 and an inwardly directed pivotal movement about the fulcrum point 7, in the direction indicated by the arrows 15. In the course of this combined movement, the lasting margin of the upper of the shoe unit 32 is wiped against the insole 65.

During the closing movement of the main wipers 6 described before, compressed air is also admitted to the secondary cylinders 44, via line 53. Thus, their pistons 48*a* are advanced so that a quantity of liquid is displaced and the jacks 30 are actuated via lines 30, whereby the ball wipers 17 are advanced during the movement of the main wipers 6 in the direction indicated by the arrows 18, and brought into firm engagement with the wiping margin of the last in the ball area. This secondary pressure ensures that the shaped surface 31 of the ball wipers 17 is advanced over the full residual travel and brought into exact engagement with the ball point 65 (FIGS. 3A, B).

Upon completion of the wiping process, the before-described parts return to their initial position, a resetting pressure being admitted to the line 58 in order to reset also the ball wipers 17. Thereafter, the wiped shoe unit 32 may be removed from the device.

The length of the path to be travelled by the ball wipers 17 during the closing movement of the main wipers 6, starting from the described intial position, is exactly adapted to each size of the full line of shoes being processed because the initial position of the ball wipers 17 is automatically adjusted in the manner described above when the heel clamp 33 engages the heel end of the shoe unit 32 (of FIGS. 3A, B). If, for instance, a smaller (shorter) shoe unit 32 as shown in broken lines in FIGS. 2, 4 is processed, the heel clamp 33 advances to the position indicated in broken lines, i.e. a position closer to the fulcrum point 7, so that a larger quantity of liquid is displaced from the cylinder space 40 of the jack 37 and the ball wipers 17 are advanced to an initial position closer to the fulcrum point 7.

By adjusting the piston rods 48 of the secondary cylinders 44 appropriately, it is also possible to adjust the symmetry of the two ball wipers 17 individually by hand. The speed-control valves 52 enable the speed of the movement of the ball wipers 17 through the residual travel to the ball point 65 to be adjusted.

Figure 2:
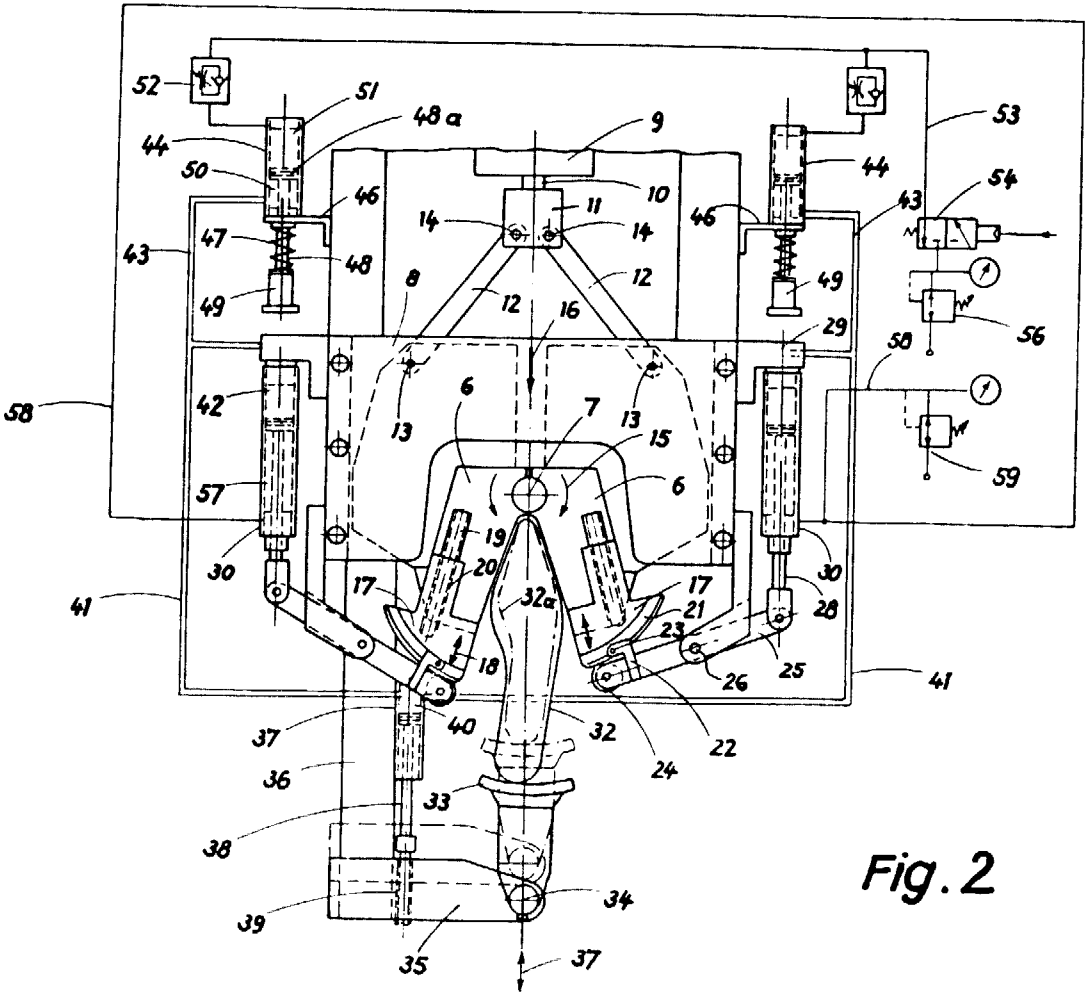
FIG. 2 is a simplified top view of the wipers of the device shown in FIG. 1, wherein certain details have been omitted.
Figure 4:
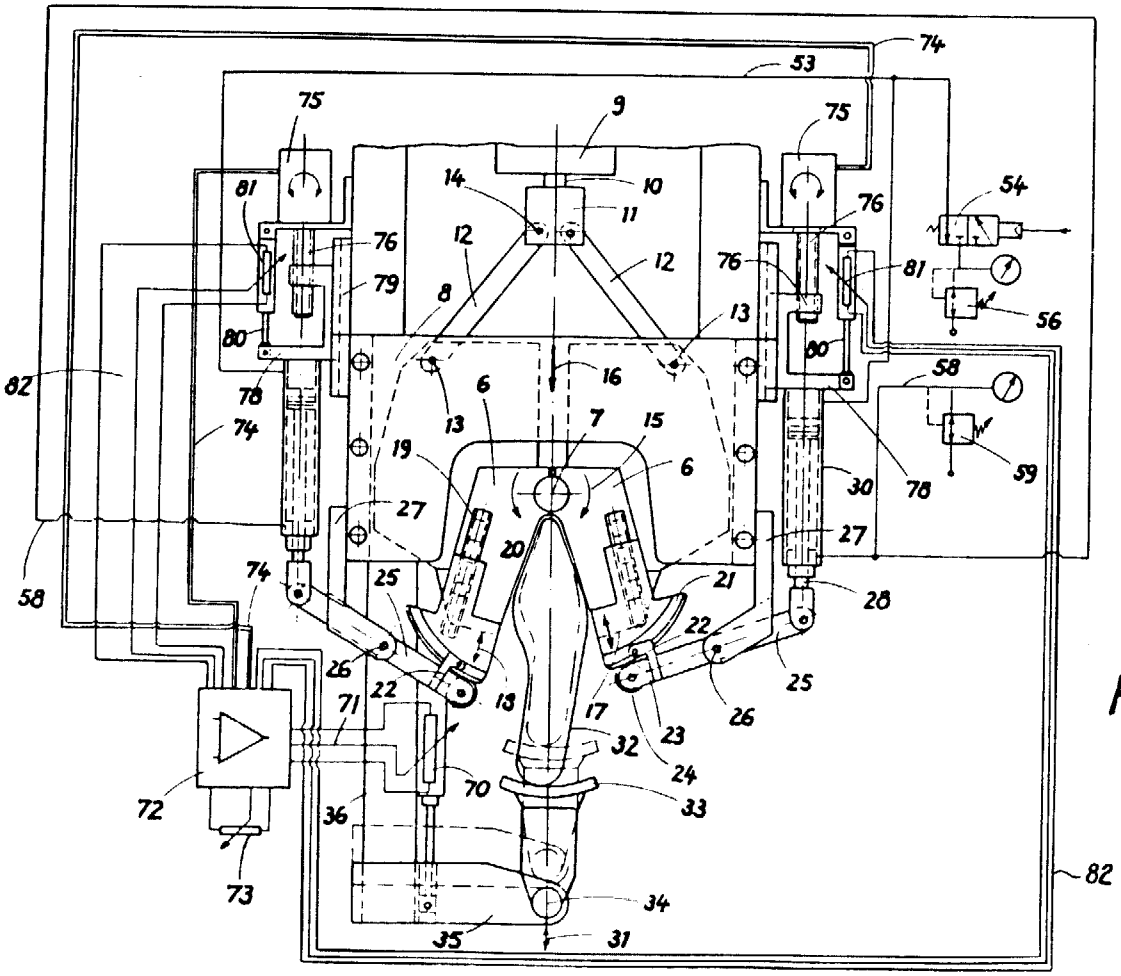
FIG. 4 shows a representation similar to that of FIG. 2 of another embodiment of the device of the invention for toe and ball lasting of a shoe unit.

The other embodiment shown in FIG. 4 differs from that shown in FIG. 2 in that the servo control for varying the initial position of the ball wipers 17 is of the electric, rather than the hydraulic type. For those parts which are identical in both embodiments, the same reference numbers have been used in both figures.

The support 32 is interconnected with a set point potentiometer 70 arranged on the guide rail 36 and acting as electric signal generator for supplying a signal indicative of the length of the mounted shoe unit 32 via line 71 to a servo amplifier 72. The latter comprises basic adjusting means for the ball wipers 17 which are indicated at 73.

The servo amplifier 72 triggers via line 74 two servomotors 75. Each of the said servomotors 75 is connected by screw drive means 76 to a guide 78 which in turn is mounted for longitudinal displacement in guide rails 79 provided on the carriage 8. The substantially U-shaped guides 78 carry on the one hand the jacks 30 and are on the other hand interconnected with the actuating element 80 of an actual-value potentiometer 81 arranged on the slide 8 and connected to the servo amplifier 72 via control lines 82.

The operation of this device is generally the same as that described in connection with the device shown in FIG. 2:

when the heel clamp 33 is brought into engagement with the mounted shoe unit 32, the set-point potentiometer 70 supplies to the servo amplifier 72 a signal indicative of the shoe length, whereupon the servo amplifier 72 triggers the servomotors 75 so that the latter adjust the jacks 30 via the supports 78 until the ball wipers 17 on the main wipers 6 occupy the correct initial position and the corresponding acknowledgement signal is supplied by the set-point potentiometer 81 to the servo amplifier 72. Thereafter, compressed air is admitted via line 53 to the jacks 30 to cause them to move the ball wipers 17 in the manner described before into engagement with the ball point 65, during the closing movement of the main wipers 6.

In principle, the servo control for varying the initial position of the ball wipers could also be of the mechanical type which means that suitable linkages, Bowden wires or the like could be used to adjust the initial position of the ball wipers 17 automatically to the length (size) of the shoe unit being processed, in response to the respective position of the heel clamp 33 and/or the support 35.

Further modifications of the invention herein disclosed will occur to persons skilled in the art and all such modifications are deemed to be within the scope of the invention as defined by the appended claims.

What is claimed is:

1. A device for toe and ball lasting a shoe unit consisting of a last with a shoe upper superimposed thereon and an insole arranged on the last bottom, comprising a shoe support acting against the shoe bottom to support the shoe unit, a heel clamp provided with adjusting means for movement towards and away from said shoe support, and main wipers seated above the shoe support for linear movement and pivotal movement about a fulcrum point and carrying, on their side opposite the fulcrum point, ball wipers arranged for longitudinal displacement, said main wipers being provided with corresponding drive means for moving them, in a combined longitudinal and pivotal inward movement, below the contour of a shoe unit placed on the shoe support, wiping simultaneously the lasting margin of the upper against the insole, during which combined movement the ball wipers can be moved by corresponding adjusting means, from an initial rearward position towards the fulcrum point, characterized in that the said device comprises a sensing element for scanning the length of the shoe unit placed upon the shoe support, and for emitting a signal indicative of the length of the said shoe unit, said sensing element coacting with adjusting means which are controlled by said signal and which serve to automatically adjust the initial position of the ball wipers on the main wipers to the respective length of the shoe unit.

2. A device in accordance with claim 1, characterized in that the sensing element is coupled with the heel-clamping means.

3. A device in accordance with claim 2, characterized in that the sensing element is coupled with the adjusting means via a servo control.

4. A device in accordance with claim 3, characterized in that the servo control comprises at least one hydraulic or pneumatic jack whose cylinder volume can be varied by the sensing element in response to the length of the shoe unit and which is connected via a line with the cylinder volume of at least one jack of the adjusting means of the ball wipers.

5. A device in accordance with claim 4, characterized in that the jack comprises resetting means.

6. A device in accordance with claim 5, characterized in that the line communicates with at least one fluid-filled space having a wall that can be adjusted by means of adjusting means.

7. A device in accordance with claim 6, characterized in that the fluid-filled space is constituted by the cylinder volume of a secondary jack, whose other cylinder volume can be subjected to the action of a pressure fluid.

8. A device in accordance with claim 3, characterized in that the sensing element is coupled with an electric signal generator and that the adjusting means of the ball wipers comprises at least one electric setting element controlled by the signal generator via a control circuit of the servo control.

9. A device for lasting a footwear assembly comprising a footwear upper mounted on a last with an insole on the last bottom, that comprises:

support means to receive the insole at the last bottom, thereby to support the footwear assembly during lasting;

main wipers mounted for a combination of linear movement and pivotal movement toward and away from the support means;

means to drive the main wipers in said combination of linear movement and pivotal movement to provide wiping action;

ball wipers adjustably secured to move with the main wipers during the wiping action, connection between the main wipers and the ball wipers permitting a position adjustment of the ball wipers relative to the main wipers on the basis of the size of the footwear upper;

sensing means operable to scan the footwear assembly and adapted to provide a signal indicative of the size thereof; and means connected to adjust automatically the ball wipers positionally relative to the main wipers on the basis of said signal.

* * * * *